US006170676B1

(12) United States Patent
Patadia et al.

(10) Patent No.: US 6,170,676 B1
(45) Date of Patent: Jan. 9, 2001

(54) FOLDABLE DISH DRAINER

(76) Inventors: Sona Patadia, 7201 Longmeadow La., Hanover Park, IL (US) 60103; Joseph Pepe Velasquez, 102 E. 15th St., Tempe, AZ (US) 85281

( * ) Notice: Under 35 U.S.C. 154(b), the term of this patent shall be extended for 0 days.

(21) Appl. No.: 09/265,177

(22) Filed: Mar. 9, 1999

(51) Int. Cl.[7] ..... A47G 19/08
(52) U.S. Cl. ..... 211/41.6; 211/41.3
(58) Field of Search ..... 211/2, 41.3, 41.4, 211/41.5, 41.6, 41.8, 41.9, 126.6, 132.1; 220/520, 572; 32/55, 56

(56) References Cited

U.S. PATENT DOCUMENTS

| | | | | |
|---|---|---|---|---|
| 395,393 | * | 1/1889 | Holzmark | 211/41.6 X |
| 946,977 | * | 1/1910 | Muller | 211/41.6 X |
| 1,714,628 | * | 5/1929 | Rodin | 211/41.6 X |
| 1,835,232 | * | 12/1931 | Lord | 211/41.6 X |
| 2,936,898 | * | 5/1960 | Miguez | 211/41.3 |
| 3,800,957 | * | 4/1974 | Krause | 211/41.3 |
| 4,169,638 | * | 10/1979 | Cirasuolo et al. | 211/41.6 X |
| 4,221,299 | * | 9/1980 | Taylor | 211/41.6 |
| 4,480,343 | * | 11/1984 | Drach | 211/41.3 X |
| 4,531,641 | * | 7/1985 | Archambault | 211/41.3 |

FOREIGN PATENT DOCUMENTS

| | | | | |
|---|---|---|---|---|
| 2042147 | * | 9/1980 | (GB) | 211/41.6 |

* cited by examiner

*Primary Examiner*—Daniel P. Stodola
*Assistant Examiner*—Curtis A. Cohen
(74) *Attorney, Agent, or Firm*—Parsons & Goltry; Robert A. Parsons; Michael W. Goltry

(57) ABSTRACT

A foldable dish drainer includes a base with first and second sections hingedly joined at adjacent parallel edges to form a dish draining surface and movable into a parallel overlying position in a folded mode. The foldable dish drainer further includes a first dish support member having one edge hingedly attached to a surface of the first base section, a second dish support member having one edge hingedly attached to a surface of the second base section, and opposed edges of the first and the second dish support members movably attached together such that when the first and second base sections are in the open mode the first and second dish support members are in an upstanding position for receiving and holding dishes in a draining position and when the first and second base sections are in the folded mode the first and second dish support members are in a folded position.

20 Claims, 1 Drawing Sheet

FIG. 1
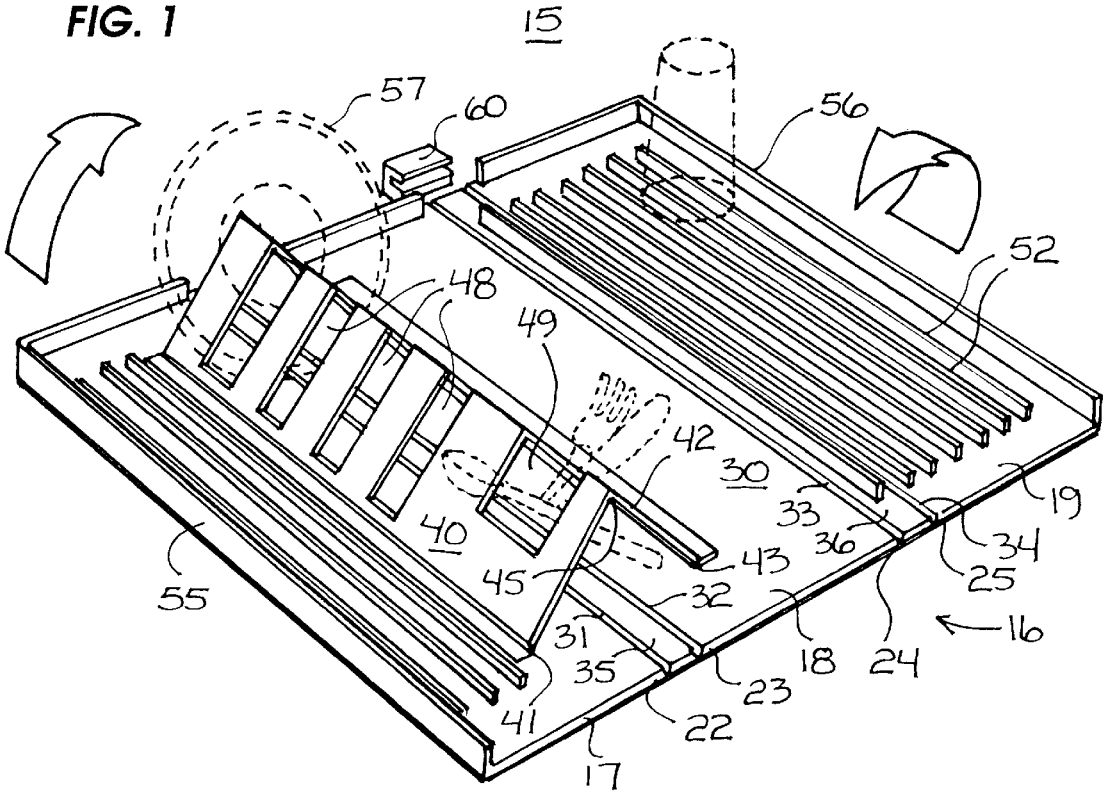
FIG. 2
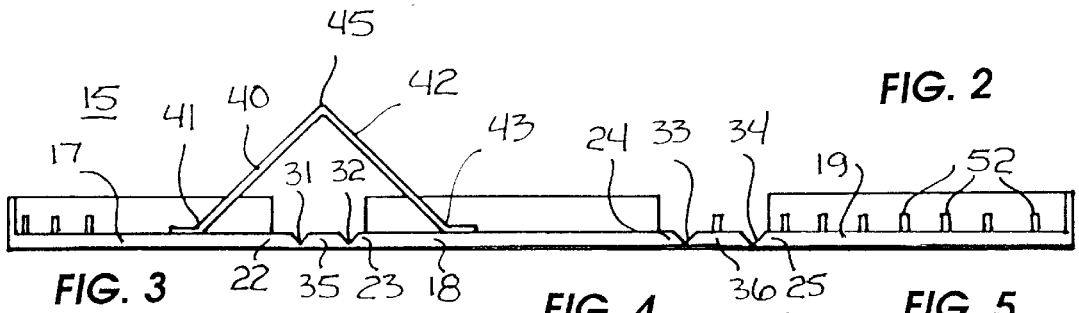
FIG. 3
FIG. 4
FIG. 5
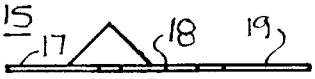
FIG. 6
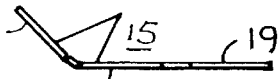
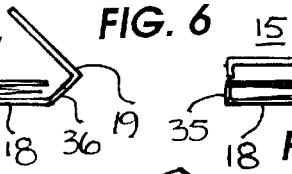
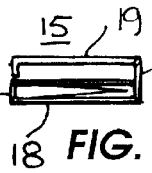
FIG. 7
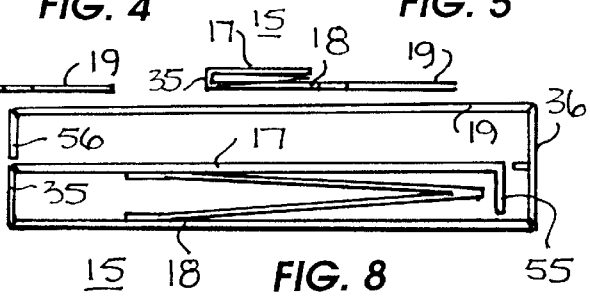
FIG. 8
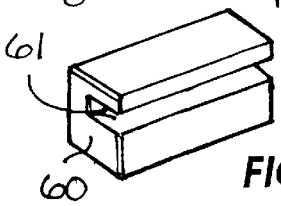
FIG. 9
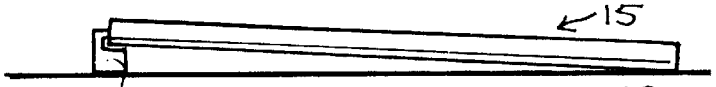
FIG. 10

FOLDABLE DISH DRAINER

BACKGROUND OF THE INVENTION

1. Field of the Invention

This invention relates generally to the field of dish drainers and the like.

More particularly, this invention relates to dish drainers which are foldable.

In a further and more specific aspect, the present invention concerns novel apparatus for dish draining and the like.

2. Prior Art

It is common in most kitchens today for a person washing dishes and other kitchen utensils to wash and rinse the dishes and then place them in dish draining apparatus to partially or completely air dry. Even in kitchens having automatic dish washers there are generally some dishes and/or kitchen utensils which need to be hand washed and drained. Also, even if some or all of the dishes and kitchen utensils are dried with a towel, rather than complete air drying, it is common to place them in a dish drainer to allow the major portion of the water to drain off before hand drying.

Generally dish drainers include a frame of hard plastic or plastic coated metal that is placed on a cupboard surface adjacent to the kitchen sink and into which dishes can be placed in an upstanding position. In some instances the frame includes a lower surface for receiving water drained from the dishes and directing it toward the kitchen sink. In some instances the frame must be placed on a plastic base which receives water drained from the dishes and directs it toward the kitchen sink. In either case the dish drainer is a relatively cumbersome article that is rather unsightly if left in the drainage position on the cupboard surface. The major problem is that the dish drainer must be quite large to receive all of the dishes and takes up a large amount of storage space when it is placed out of sight in a storage area. Further, the storage area must be relatively conveniently located so that the dish drainer can be quickly and easily removed from storage and used several times a day.

It would be highly advantageous, therefore, to remedy the foregoing and other deficiencies inherent in the prior art.

Accordingly, it is an object of the present invention to provide a new and improved foldable dish drainer.

It is another object of the instant invention to provide a new and improved foldable dish drainer that can be easily used in a normal fashion.

It is a further object of the instant invention to provide a new and improved dish drainer that can be easily used in a normal fashion and easily folded into a convenient storage form.

SUMMARY OF THE INVENTION

Briefly, to achieve the desired objects of the instant invention in accordance with a preferred embodiment thereof, a foldable dish drainer includes a base with first and second sections hingedly joined at adjacent parallel edges to form a dish draining surface and movable into a parallel overlying position in a folded mode. The dish drainer further includes a first dish support member having one edge hingedly attached to a surface of the first base section, a second dish support member having one edge hingedly attached to a surface of the second base section, and opposed edges of the first and the second dish support members movably attached together such that when the first and second base sections are in the open mode the first and second dish support members are in an upstanding position for receiving and holding dishes in a draining position and when the first and second base sections are in the folded mode the first and second dish support members are in a folded position.

In a preferred embodiment, a third base section is movably attached to one of the first and second base sections to extend the dish draining area. The third base section is foldable with the first and second base sections into a folded mode wherein the three sections are in overlying relationship with the first and second dish support members folded therebetween.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 1 is an isometric view of a foldable dish drainer in accordance with the present invention;

FIG. 2 is a view in end elevation of the foldable dish drainer of FIG. 1, in an unfolded or open mode;

FIGS. 3 through 7 are a series of semi-schematic simplified views (reduced in size for convenience) illustrating various steps in the process of folding the foldable dish drainer of FIG. 1;

FIG. 8 is a view in side elevation of the foldable dish drainer in a folded mode;

FIG. 9 is an isometric view of a holding block for use with the folding dish drainer of FIG. 1; and FIG. 10 is a side elevation view of the holding block of FIG. 9 in cooperation with the folding dish drainer of FIG. 1.

DETAILED DESCRIPTION OF THE PREFERRED EMBODIMENT

Turning now to the drawings, in which like reference characters indicate corresponding elements throughout the several views, attention is first directed to FIG. 1 illustrating a folding dish drainer 15 in accordance with the present invention. Folding dish drainer 15 includes a base member 16, which in this preferred embodiment is formed of three base sections 17, 18, and 19. Here it should be understood that as few as two base sections could be included or three or more could be included for special circumstances. Also, while base sections 17, 18, and 19 are formed at least partially of plastic in this embodiment, it will be understood that any convenient material, e.g. metal, plastic coated metal, etc. could be used if desired.

Base section 17 has an edge 22 movably joined to an edge 23 of base section 18 and base section 18 has a second edge 24 movably joined to an edge 25 of base section 19 to form a dish draining surface 30. In this preferred embodiment base sections 17, 18, and 19 are formed from one continuous piece and edges 22, 23, 24, and 25 are defined by forming grooves 31, 32, 33, and 34, respectively, in the upper surface 30 of base member 16. As can be seen more clearly by referring additionally to FIG. 2, grooves 31, 32, 33, and 34 are formed with a generally V-shaped cross-section to enhance the folding of base member 16. as will be described in more detail presently. Grooves 31 and 32, along with a small intermediate section 35, hingedly connect base sections 17 and 18 together for relative folding movement while presenting a complete waterproof upper surface for base member 16 for the drainage of water. Also, grooves 33 and 34, along with a small intermediate section 36, hingedly connect base sections 18 and 19 together for relative folding movement while presenting a complete waterproof upper surface for base member 16 for the drainage of water.

A dish support member 40 has a parallel edge 41 movably attached to the upper surface of base section 17 and a second dish support member 42 has a parallel edge 43 movably attached to the upper surface of base section 18. Dish support members 40 and 42 each have a second edge spaced from edges 41 and 43, respectively, and movably joined together to form a movable joint 45. In this preferred embodiment dish support members 40 and 42 are hingedly attached to base sections 17 and 18, respectively, and to each other along the opposite edges (joint 45) by means of hinges formed in a fashion similar to the formation of the hinges between base sections 17 and 18 and between base sections 18 and 19. Also, dish support members 40 and 42 form an upstanding structure with a generally triangularly shaped cross-section in this embodiment but it will be understood that other configurations (e.g. square, semi-circular, etc.) can be devised and all such structures which perform the functions described herein come within the scope of this invention. It will also be understood that many other forms of movably connecting the various sections and members may be utilized and they will still come within the scope of this invention. Joint 45 and the movable connections of dish support members 40 and 42 to base sections 17 and 18, respectively, are movably attached together such that when base sections 17 and 18 are in the open mode, illustrated in FIGS. 1 and 2, dish support members 40 and 42 are in an upstanding position for receiving and holding dishes in a draining position and when base sections 17 and 18 are in a folded mode (to be explained in conjunction with FIG. 8) dish support members 40 and 42 are in a folded mode.

As can be seen best by referring to FIG. 1, dish support members 40 and 42 have a plurality of openings 48 therein which combine to form slots for receiving dishes therein (illustrated in broken lines in FIG. 1) in an upstanding or draining position. Also, other openings, such as openings 49 can be formed in dish support members 40 and 42 for receiving utensils (e.g. knives, forks, etc.) in upstanding or draining positions. It will be understood that more or fewer openings may be provided and different shaped openings for different types of dishes may be provided. Further, base section 19 has a plurality of parallel ridges 52 extending from adjacent one end to adjacent the other end and provided to allow certain dishes (e.g. glasses and the like) to be inverted thereover. Ridges 52 not only hold the dishes above the surface 30 to enhance drying, but also direct water flow from one end to the other. To further enhance water movement in a desired direction, the outer edges of base sections 17 and 19 have upstanding ridges or walls 55 and 56, respectively, formed therealong. Wall 55 also extends along the rear end of base section 17 and wall 56 also extends along the rear end of base section 19. An upstanding ridge or wall 57 is formed along the rear end of base section 18 to cooperate with walls 55 and 56 to enhance water flow in the direction of the front ends of base sections 17, 18, and 19.

Turning now to FIGS. 3 through 7, a series of semi-schematic simplified views (reduced in size for convenience) are included to illustrate various steps in the process of folding foldable dish drainer 15. Referring specifically to FIG. 3, foldable dish drainer 15 is illustrated in an open or useable position (see also FIG. 2 for a complete view). Referring to FIG. 4, it can be seen that the folding process begins by folding or rotating base section 17 upwardly and clockwise relative to base section 18. In FIG. 5 the first folding step has been completed and base section 17 is positioned in substantially parallel overlying relationship relative to base section 18. Also, dish support members 40 and 42 fold together into a substantially parallel overlying relationship between base sections 17 and 18. Here it should be understood that joint 45 of dish support members 40 and 42 could be constructed with a small section between the edges so that base sections 17 and 18 could be folded in the opposite direction and base sections 17 and 18 would be on the inside of dish support members 40 and 42 in the folded mode, which position is still considered as a substantially parallel overlying position. Also, other folding configurations can be devised and all such embodiments which perform the functions of the present invention are considered to come within the claims of the present invention. Referring specifically to FIG. 6, it can be seen that base section 19 is now folded or rotated counter-clockwise over folded base sections 17 and 18 to complete the folding, as illustrated in FIG. 7.

Referring specifically to FIG. 8, foldable dish drainer 15 is illustrated in the completely folded mode. As can be seen in FIG. 8, the width of intermediate sections 35 and 36 and the height of walls 55, 56, and 57 are generally selected to form a compact package. For example, it is preferable that the width of intermediate section 35 and the height of wall 56 are approximately equal to the width of intermediate section 36 so that base sections 17, 18, and 19 are supported in the folded mode and are not likely to be bent beyond their foldable range. Further, because foldable dish drainer 15 folds into a fairly rugged box-like structure it can be easily stored, other devices can be placed on top of it, or it could be decorated on the outside and simply left on a cupboard surface.

Turning now to FIG. 9, an optional holding block 60 is illustrated. Holding block 60 has an elongated construction with a generally rectangular cross-section and a slot 61 formed in one side. Holding block 60 (or two if desired) is designed to be positioned at the rear end of base sections 18 and 19 (see FIG. 1) and/or the rear end of base sections 17 and 18 for preventing the base sections from moving from the open mode toward the folded mode. The rear edge of base sections 18 and 19 and/or 17 and 18 are frictionally engaged in slot 61 of holding block 60 to substantially complete the wall along the rear end of base member 16 and to prevent inadvertent folding of base members 17, 18, or 19. In a preferred embodiment, holding block 60 extends downwardly from the base members 17 and 18 or 18 and 19 for inclining planar upper surface 30 of base member 16 in the open mode, as illustrated in FIG. 10, to enhance runoff of fluid toward the front edge. Holding block (or blocks) 60 can be specifically designed to be stored within folding dish drainer 15 in the folded mode. Also, it should be understood that holding block 60 is illustrated as a single example of a holding and inclining device, many others of which might be devised. For example, folding dish drainer 16 can be constructed with lower ridges positioned to prevent over rotating base sections 17, 18, and 19 and further constructed to provide an incline to foldable dish drainer 15 in the open mode.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A foldable dish drainer comprising:

a base member including a first base section with a first edge and a second base section with a first edge, the first and second base sections being movably joined at the first edges to form a substantially continuous dish draining surface in an open mode and to place the first and second base sections in a substantially parallel overlying position in a folded mode, and the substantially continuous dish draining surface extending across and defined by the first and second base sections;

a first dish support member having first and second spaced apart edges with the first spaced apart edge of the first dish support member being movably attached to a surface of the first base section of the base member;

a second dish support member having first and second spaced apart edges with the first spaced apart edge of the second dish support member being movably attached to a surface of the second base section of the base member; and the second spaced apart edges of the first dish support member and the second dish support member being movably attached together such that when the first and second base sections are in the open mode the first and second dish support members are in an upstanding position for receiving and holding dishes in a draining position overlying the dish draining surface and when the first and second base sections are in the folded mode the first and second dish support members are in a folded position.

2. A foldable dish drainer as claimed in claim 1 wherein the base member is formed of plastic.

3. A foldable dish drainer as claimed in claim 1 wherein the base member is formed as a continuous piece.

4. A foldable dish drainer as claimed in claim 3 wherein the base member is formed of a substantially flat piece of material with a generally planar upper surface when the first and second base sections are in the open mode.

5. A foldable dish drainer as claimed in claim 4 wherein the first edge of the first base section and the first edge of the second base section are defined by spaced apart grooves extending partially through the continuous piece.

6. A foldable dish drainer as claimed in claim 4 including in addition a holding block positioned at one end of the base member for preventing the first and second base sections from moving from the open mode to the folded mode.

7. A foldable dish drainer as claimed in claim 6 wherein the holding block extends downwardly from the base member for inclining the planar upper surface in the open mode to allow runoff of fluid.

8. A foldable dish drainer as claimed in claim 1 wherein the base member includes a third base section with a first edge and the second base section has a second edge, the second edge of the second base section and first edge of the third base section being movably joined to form an extended dish draining surface in an open mode and to place the first, second and third base sections in a substantially parallel overlying position in a folded mode.

9. A foldable dish drainer as claimed in claim 8 wherein the third base section includes a plurality of parallel spaced apart ridges on the generally planar upper surface.

10. A foldable dish drainer as claimed in claim 9 wherein the first base section has a second edge and the third base section has a second edge, the second edges of the first and third base sections each having a ridge extending therealong and upstanding from the generally planar upper surface.

11. A foldable dish drainer as claimed in claim 8 wherein the base member is formed of a substantially flat piece of material with a generally planar upper surface when the first, second, and third base sections are in the open mode.

12. A foldable dish drainer as claimed in claim 11 wherein the second edge of the second base section and the first edge of the third base section are defined by spaced apart grooves extending partially through the continuous piece.

13. A foldable dish drainer as claimed in claim 1 wherein the first and second dish support members are joined to form an upstanding dish support with a generally triangularly shaped cross-section, the upstanding dish support having a plurality of openings defined therein for receiving plates and kitchen utensils in an upstanding position.

14. A foldable dish drainer comprising:

a base member including a first base section with a first edge and a second base section with a first edge, the first and second base sections being hingedly joined at the first edges to form a substantially continuous dish draining surface in an open mode and to place the first and second base sections in a substantially parallel overlying position in a folded mode, and the substantially continuous dish draining surface extending across and defined by the first and second base sections;

a first dish support member having first and second spaced apart parallel edges with the first parallel edge of the first dish support member being hingedly attached to a surface of the first base section of the base member;

a second dish support member having first and second spaced apart parallel edges with the first parallel edge of the second dish support member being hingedly attached to a surface of the second base section of the base member; and the second edges of the first dish support member and the second dish support member being hingedly attached together such that when the first and second base sections are in the open mode the first and second dish support members are in an upstanding position relative to the dish draining surface for receiving and holding dishes in a draining position overlying the dish draining surface and when the first and second base sections are in the folded mode the first and second dish support members are in a substantially parallel overlying folded position between the first and second base sections.

15. A foldable dish drainer as claimed in claim 14 wherein the base member is formed of plastic.

16. A foldable dish drainer as claimed in claim 15 wherein the base member is formed of a substantially flat continuous piece of material with a generally planar upper surface when the first and second base sections are in the open mode.

17. A foldable dish drainer as claimed in claim 16 wherein the first edge of the first base section and the first edge of the second base section are defined by parallel spaced apart grooves extending partially through the continuous piece.

18. A foldable dish drainer as claimed in claim 17 including in addition a holding block positioned at one end of the base member for preventing the first and second base sections from moving from the open mode to the folded mode and for inclining the planar upper surface in the open mode to allow runoff of fluid.

19. A foldable dish drainer as claimed in claim 14 wherein the base member is formed of a substantially flat piece of material with a generally planar upper surface and includes a third base section with a first edge and the second base section has a second edge, the second edge of the second base section and first edge of the third base section being hingedly joined to form an extended dish draining surface in an open mode and to place the first, second and third base sections in a substantially parallel overlying position in a folded mode.

20. A foldable dish drainer comprising:

a base member including a first base section with a first edge and a second base section with a first edge, the first and second base sections being hingedly joined at the first edges to form a substantially continuous dish draining surface in an open mode and to place the first and second base sections in a substantially parallel overlying position in a folded mode, the first and second base sections including plastic and being formed as a continuous piece with a generally planar upper surface extending across and defined by the first and second base sections when the first and second base sections are in the open mode, the first edge of the first base section and the first edge of the second base section being defined by parallel spaced apart grooves extending partially through the continuous piece to hingedly join the first and second base sections;

a first dish support member having first and second spaced apart parallel edges with the first parallel edge of the first dish support member being hingedly attached to a surface of the first base section of the base member;

a second dish support member having first and second spaced apart parallel edges with the first parallel edge of the second dish support member being hingedly attached to a surface of the second base section of the base member; and the second edges of the first dish support member and the second dish support member being hingedly attached together such that when the first and second base sections are in the open mode the first and second dish support members are in an upstanding position relative to the dish draining surface for receiving and holding dishes in a draining position overlying the dish draining surface and when the first and second base sections are in the folded mode the first and second dish support members are in a substantially parallel overlying folded position between the first and second base sections, the first and second dish support members being joined to form an upstanding dish support with a generally triangularly shaped cross-section, the upstanding dish support having a plurality of openings defined therein for receiving plates and kitchen utensils in an upstanding position.

* * * * *